US010006469B2

(12) United States Patent
Cocks et al.

(10) Patent No.: US 10,006,469 B2
(45) Date of Patent: Jun. 26, 2018

(54) DIFFUSER AND METHOD OF OPERATING DIFFUSER

(71) Applicant: Regal Beloit America, Inc., Beloit, WI (US)

(72) Inventors: Rachele Cocks, Columbia City, IN (US); Samuel Spieth, Woodburn, IN (US)

(73) Assignee: Regal Beloit America, Inc., Beloit, WI (US)

( * ) Notice: Subject to any disclaimer, the term of this patent is extended or adjusted under 35 U.S.C. 154(b) by 556 days.

(21) Appl. No.: 14/318,868

(22) Filed: Jun. 30, 2014

(65) Prior Publication Data

US 2015/0377249 A1 Dec. 31, 2015

(51) Int. Cl.
*F04D 29/44* (2006.01)
*F04D 29/42* (2006.01)

(52) U.S. Cl.
CPC ..... *F04D 29/441* (2013.01); *F04D 29/422* (2013.01); *F04D 29/444* (2013.01); *F05D 2250/52* (2013.01); *F05D 2250/713* (2013.01)

(58) Field of Classification Search
CPC .... F04D 29/444; F04D 29/441; F04D 29/422; F04D 29/403; F04D 29/4226; F05D 2250/52
See application file for complete search history.

(56) References Cited

U.S. PATENT DOCUMENTS 3,362,469 A 1/1968 Berner et al.
4,750,693 A 6/1988 Lobert et al.
5,316,439 A 5/1994 Gatley et al.
5,868,551 A 2/1999 Smiley et al.
6,039,532 A 3/2000 McConnell
6,146,092 A 11/2000 Botros et al.
8,047,776 B2 * 11/2011 Della Mora ..... F04D 29/422 415/203
8,197,203 B2 6/2012 Jairazbhoy et al.
8,337,145 B2 * 12/2012 Frater ..... A61M 16/0057 128/200.24

(Continued)

FOREIGN PATENT DOCUMENTS

DE 2933358 A1 2/1981
DE 102006020312 A1 11/2007

(Continued)

OTHER PUBLICATIONS

European Extended Search Report, Application No. 15167726.7, dated Dec. 16, 2015, pp. 9.

(Continued)

*Primary Examiner* — Richard Edgar
*Assistant Examiner* — John S Hunter
(74) *Attorney, Agent, or Firm* — Armstrong Teasdale LLP

(57) ABSTRACT

In one aspect, a diffuser for expanding the cross-sectional area of an airstream comprises an inlet comprising an inlet cross-sectional area and an outlet comprising an outlet cross-sectional area. The outlet cross-sectional area is greater than the inlet cross-sectional area. A curved sidewall extends from the inlet to the outlet and at least partially defines an inner passageway. The curved sidewall comprises a convex portion and a concave portion. The convex portion is adjacent the inlet and the concave portion is adjacent the outlet.

20 Claims, 8 Drawing Sheets

(56) References Cited

U.S. PATENT DOCUMENTS

| | | | | |
|---|---|---|---|---|
| 8,535,002 | B2 | 9/2013 | Jairazbhoy et al. | |
| 8,690,529 | B2 * | 4/2014 | Tanaka | F04D 29/4226 415/204 |
| 2009/0232648 | A1 | 9/2009 | Wu | |
| 2012/0034077 | A1 | 2/2012 | Jairazbhoy et al. | |
| 2012/0168117 | A1 | 7/2012 | Jairazbhoy et al. | |
| 2015/0337862 | A1 | 11/2015 | Rao | |

FOREIGN PATENT DOCUMENTS

| | | | |
|---|---|---|---|
| JP | 2002147789 | A | 5/2002 |
| JP | 2005351205 | A | 12/2005 |
| JP | 2007138844 | | 6/2007 |

OTHER PUBLICATIONS

Office Action dated Oct. 20, 2016, U.S. Appl. No. 14/280,121; Regal Beloit America, Inc., 15 pages.

* cited by examiner

DIFFUSER AND METHOD OF OPERATING DIFFUSER

BACKGROUND

The field of this disclosure relates generally to a diffuser for use in an air handling system, and more specifically, to a diffuser for directing and expanding the cross-sectional area of an airstream circulating in a heating, ventilating, and air conditioning (HVAC) system.

Some HVAC systems include portions of the system that increase the cross-sectional area of the airstream, such as where the airstream exits a blower assembly. However, as the area of the airstream increases, the velocity decreases, i.e., the downstream air loses momentum. Since airstream pressure is inversely proportional to airstream velocity, the pressure in the airstream increases as the velocity decreases. This non-ideal expansion and subsequent increases in pressure generate adverse flow structures. The term "adverse flow structures" designates flow structures in an airstream that have negative effects on HVAC system operation, such as recirculation, vortexes, turbulence, and eddies. These adverse flow structures and the increased pressure result in energy losses for the HVAC system and, therefore, decrease the efficiency of the system. The energy losses are more pronounced in HVAC systems without expansion or transition pieces to optimally change the cross-sectional area of the airstream.

Diffusers are commonly used as expansion or transition pieces for expanding the cross-sectional area of airstreams flowing through HVAC systems. Diffusers are coupled with exhaust outlets or duct sections. Instead of an immediate change in cross-sectional area, traditional diffusers use an inclined wall to gradually change the cross-sectional area. However, in some HVAC systems the airstream separates from the inclined wall causing areas of low pressure, i.e., vacuum pockets, along the inclined wall. Higher-pressure air recirculates to fill the vacuum pockets, resulting in the generation of unfavorable flow structures in the airstream.

Additionally, it is sometimes necessary to change the direction of an airstream in an HVAC system at the same location as a change in cross-sectional area, for example, when the airstream exits the blower assembly. The change in direction also causes the airstream to separate from a wall of the HVAC system and the separation generates unfavorable flow structures.

BRIEF DESCRIPTION

In one aspect, a diffuser for expanding the cross-sectional area of an airstream comprises an inlet comprising an inlet cross-sectional area and an outlet comprising an outlet cross-sectional area. The outlet cross-sectional area is greater than the inlet cross-sectional area. A curved sidewall extends from the inlet to the outlet and at least partially defines an inner passageway. The curved sidewall comprises a convex portion and a concave portion. The convex portion is adjacent the inlet and the concave portion is adjacent the outlet.

In another aspect, a method for expanding and directing an airstream in a diffuser comprises channeling an airstream through a diffuser. The airstream is channeled into the diffuser through an inlet. The airstream has a first cross-sectional area when the airstream enters the diffuser at the inlet. The diffuser includes a first curved wall with a first curve and a second curve. The airstream is channeled in a first direction along the first curve of the first curved wall.

The cross-sectional area of the airstream is expanded to a second cross-sectional area as the airstream moves along the first curved wall. The airstream is channeled in a second direction as the airstream moves along the second curve of the first curved wall. The airstream is exhausted from an outlet.

In yet another aspect, an air handling system comprises a diffuser, a radial blower configured to move an airstream and a blower housing configured to house the blower and channel the airstream around the blower. The blower housing includes a blower outlet configured to exhaust the airstream. The diffuser comprises a curved wall, a diffuser inlet configured to receive the airstream from said blower, and a diffuser outlet configured to exhaust the airstream. The diffuser comprising a first cross-sectional area at the diffuser inlet and a second cross-sectional area at the diffuser outlet. The second cross-sectional area is greater than the first cross-sectional area. The curved wall includes a first curve and a second curve.

DETAILED DESCRIPTION

Described below are a diffuser with a curved wall and a method of using a diffuser with a curved wall. The diffuser with a curved wall can simultaneously change the cross-sectional area and the direction of an airstream. The curved wall redirects the airstream prior to expanding the cross-sectional area, which helps the airstream maintain a laminar flow along the curved wall, i.e., the airstream does not separate from the curved wall. The curved wall also smoothly transitions the airstream to a new direction while minimizing separation of the airstream from the curved wall and maintaining a substantially constant air pressure along the curved wall. The separation of the airstream from a traditional diffuser wall causes unfavorable flow structures and inefficient flow of the airstream. Therefore, by maintaining a laminar flow, the diffuser's curved wall increases the efficient flow of the airstream and minimizes the generation of unfavorable flow structures.

Figure 1:
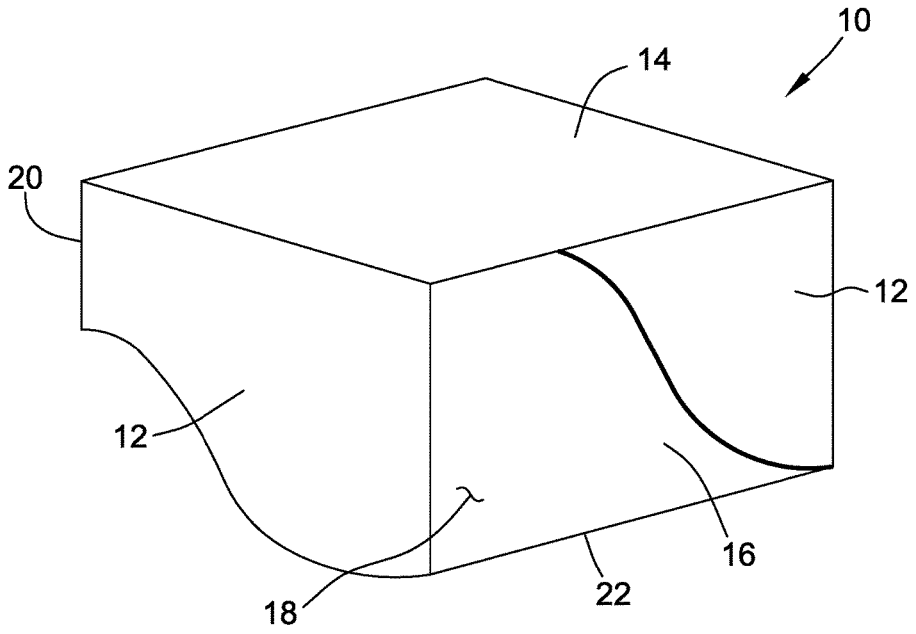
FIG. 1 is a perspective view of a diffuser illustrating a curved bottom wall.

FIG. 1 is perspective view of an exemplary embodiment of a diffuser 10. In the exemplary embodiment, diffuser 10 has two sidewalls 12, a top wall 14, and a curved bottom wall 16. Sidewalls 12, top wall 14, and curved bottom wall 16 define an interior space 18 with a diffuser inlet 20 at one end and a diffuser outlet 22 at the other end. In alternate embodiments, diffuser 10 has any number of sidewalls, inlets, and outlets that enable diffuser 10 to function as described herein. For example, in one embodiment (not shown), a cylindrical diffuser has one circular sidewall, wherein a portion of the circular sidewall also curves in the direction of an airstream flowing through the diffuser.

In the exemplary embodiment, the cross-sectional area of interior space 18 gradually increases from diffuser inlet 20 to diffuser outlet 22. Sidewalls 12 are spaced equidistant from each other along their entire area. Top wall 14 and curved bottom wall 16 are coupled between sidewalls 12 and spaced a varying distance from each other. The distance between curved bottom wall 16 and top wall 14 increases from diffuser inlet 20 to diffuser outlet 22. In the exemplary embodiment, top wall 14 is flat along its entire area. In alternate embodiments, top wall 14 and sidewalls 12 are curved and/or inclined.

Figure 2:
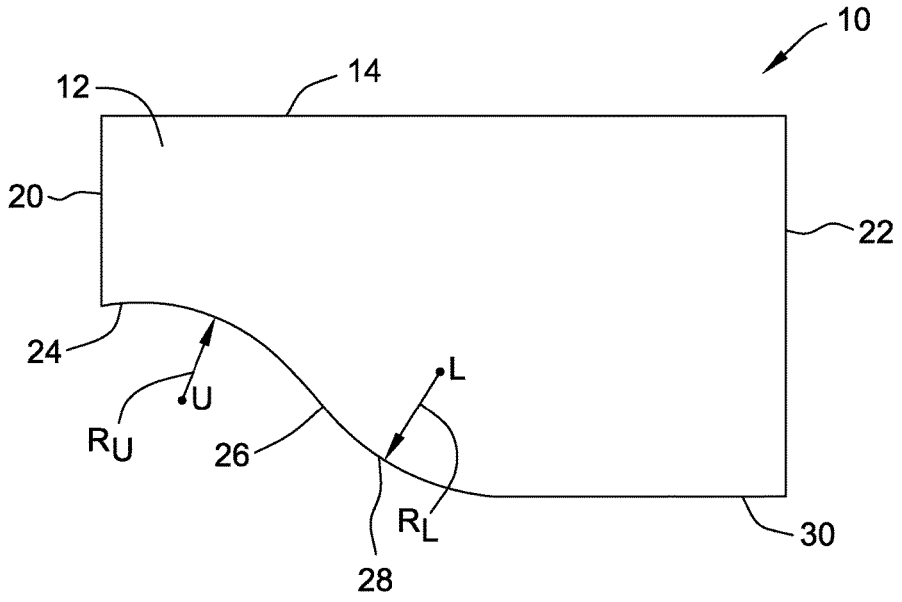
FIG. 2 is a side view of the diffuser shown in FIG. 1.

FIG. 2 is a side view of diffuser 10. In the exemplary embodiment, curved bottom wall 16 has a first curved portion 24, a substantially straight portion 26, and a second curved portion 28. First curved portion 24 is located adjacent diffuser inlet 20 and gradually curves away from top wall 14. From the reference of interior space 18, first curved portion 24 is convex. Second curved portion 28 is located adjacent diffuser outlet 22. From the reference of interior space 18, second curved portion 28 is concave. Straight portion 26 extends between first curved portion 24 and second curved portion 28. Straight portion 26 provides a transition from first curved portion 24 to second curved portion 28. In an alternate embodiment, straight portion 26 is omitted. In the exemplary embodiment, lower straight portion 30 extends from second curved portion 28 to diffuser outlet 22. In alternate embodiments, curved bottom wall 16 curves in any direction, has any number of curves, and has any number of straight sections that enable diffuser 10 to function as described herein.

In the exemplary embodiment, first curved portion 24 has an upper radius $R_u$. In one embodiment, upper radius $R_u$ gradually changes along first curved portion 24 to enable an airstream (not shown) to follow first curved portion 24. In the exemplary embodiment, second curved portion 28 has a lower radius $R_L$. In one embodiment, lower radius $R_L$ gradually changes along second curved portion 28 to enable the airstream to follow second curved portion 28. In another suitable embodiment, the shape of first curved portion 24 and second curved portion 28 may be based on mathematical formulas to give first curved portion 24 and second curved portion 28 an elliptical, parabolic, or other mathematical curve shape.

Figure 3:
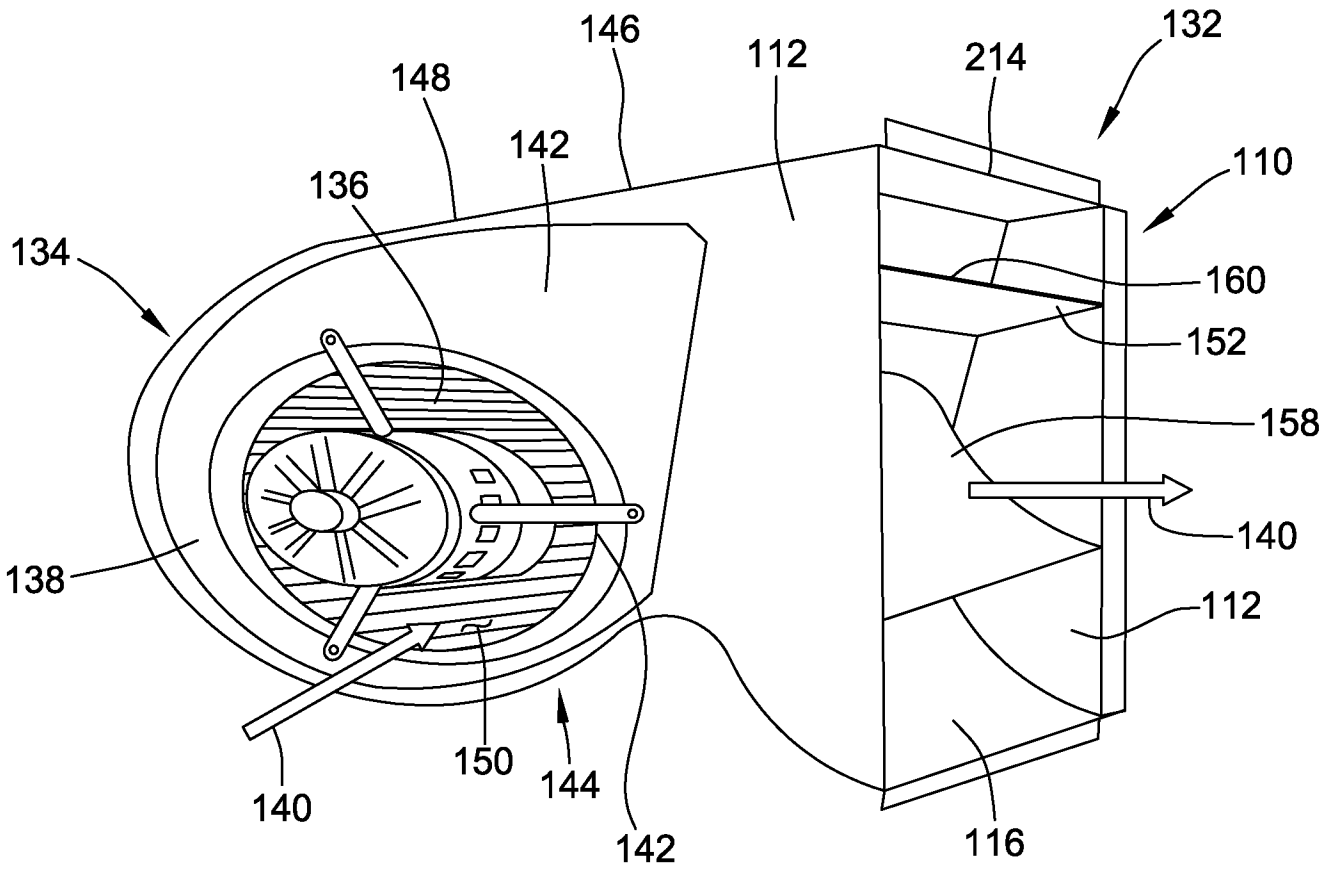
FIG. 3 is a perspective view of a blower assembly including a diffuser having a curved bottom wall.

FIG. 3 is a perspective view of an exemplary centrifugal blower assembly 132 including a diffuser 110. In the exemplary embodiment, blower assembly 132 includes a fan impeller 136 inside a housing 134. Fan impeller 136 is coupled to a motor 138, which is configured to rotate fan impeller 136. The rotation of fan impeller 136 draws an airstream 140 into blower assembly 132.

In the exemplary embodiment, housing 134 includes a first sidewall 142 and an opposite second sidewall 144. First sidewall 142 and second sidewall 144 are generally flat, parallel sidewalls disposed at axially opposite ends of fan impeller 136. Outer peripheries 146 of both first sidewall 142 and second sidewall 144 are shaped substantially the same and generally form a volute shape. A scroll wall 148 is coupled between first sidewall 142 and second sidewall 144. More specifically, scroll wall 148 is coupled to outer periphery 146 of first sidewall 142 and second sidewall 144, thereby forming an increasing expansion angle for airstream 140 through housing 134 around fan impeller 136.

Housing 134 includes an air inlet opening 150 provided in first sidewall 142. First sidewall 142, second sidewall 144, and scroll wall 148 define, at least in part, an air outlet opening 152. In the exemplary embodiment, blower assembly 132 exhausts airstream 140 through air outlet opening 152. Further, motor 138 of blower assembly 132 is disposed in air inlet opening 150 and is coupled to housing 134. In an alternate embodiment, second sidewall 144 includes an opening (not shown) to facilitate accommodating motor 138.

Figure 4:
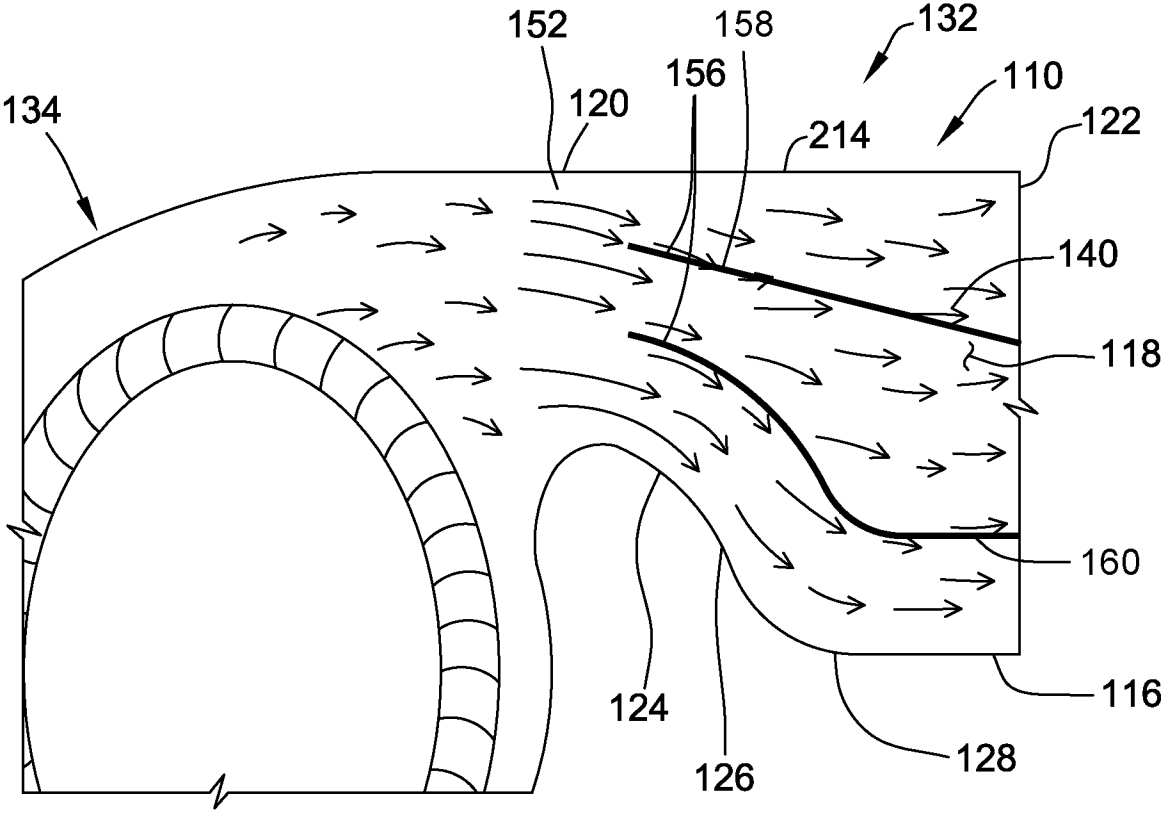
FIG. 4 is a side view of the blower assembly shown in FIG. 3.

FIG. 4 is a side view of blower assembly 132 illustrating the path of airstream 140 through diffuser 110. Diffuser 110 is coupled to housing 134 adjacent air outlet opening 152. In the exemplary embodiment, diffuser 110 comprises two sidewalls 112, a top wall 214, and a curved bottom wall 116. Sidewalls 112, top wall 214, and curved bottom wall 116 define an interior space 118 with a diffuser inlet 120 at one end and a diffuser outlet 122 at the other end similar to interior space 18 of diffuser 10.

In the exemplary embodiment, diffuser 110 includes a turning vane 156 having two vane panels 158, 160 spaced apart to enable a portion of airstream 140 to pass between vane panels 158, 160. Each vane panel 158, 160 includes a metal plate extending between and coupled to sidewalls 112. Vane panel 158 angles in relation to the direction of airstream 140 to direct airstream 140 towards vane panel 160 and curved bottom wall 116; the angle between vane panel 158 and the direction of airstream 140 is an acute angle, i.e., an angle between 0° and 90°. In contrast, vane panel 160 curves similar to curved bottom wall 116 to facilitate airstream 140 expanding efficiently and following curved bottom wall 116. In an alternate embodiment, diffuser 110 includes any number of turning vanes 156 having any size, shape, and material that enables turning vanes 156 to function as described herein. For example, in an alternate embodiment, a turning vane (not shown) could have a vane panel with a straight angled section similar to vane panel 158 and a curved section similar to vane panel 160. Furthermore, in an alternate embodiment, turning vane 156 is coupled to housing 134 and/or diffuser 110. Additionally, turning vane 156 may be used independently of diffuser 110 in any section of an HVAC system to direct an airstream.

In the exemplary embodiment, curved bottom wall 116 has a first curved portion 124, a straight portion 126, and a second curved portion 128 similar to first curved portion 24, straight portion 26, and second curved portion 28 of diffuser 10. In alternate embodiments, one or more of sidewalls 112 and top 214 are curved.

In operation, fan impeller 136 rotates to draw air into housing 134 through air inlet opening 150 and generates high velocity airstream 140 that is exhausted from air outlet opening 152 into diffuser 110. After exiting housing 134, airstream 140 enters diffuser 110 through diffuser inlet 120 and is exhausted through diffuser outlet 122. The cross-sectional area of diffuser 110 gradually increases from diffuser inlet 120 to diffuser outlet 122. As airstream 140 flows through diffuser 110, airstream 140 expands to fill the larger cross-sectional area of diffuser outlet 122.

Figure 5:
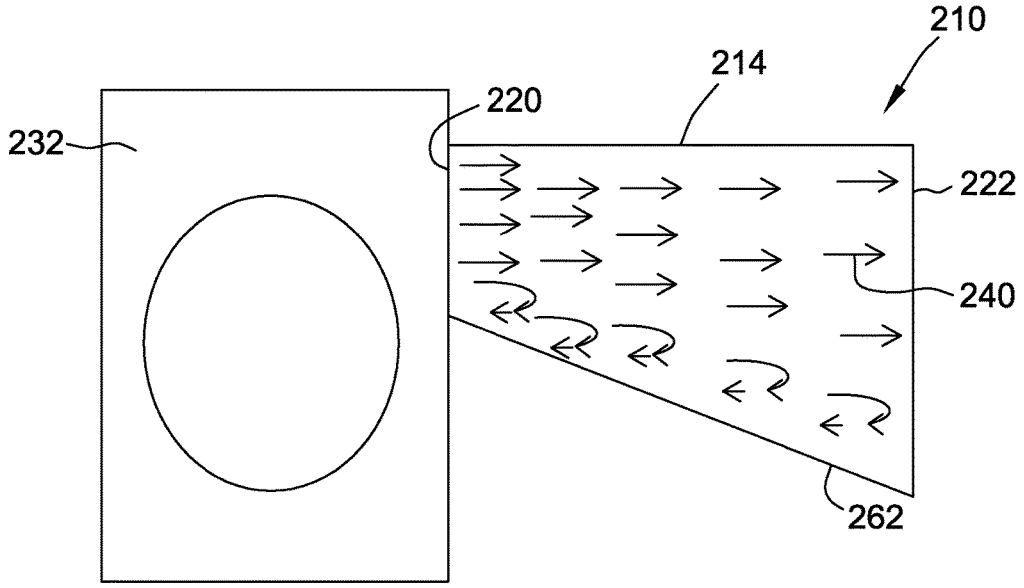
FIG. 5 is a side view of a blower assembly coupled to a diffuser having an inclined wall.

FIG. 5 is a side view of a blower assembly 232 coupled to a diffuser 210 having an inclined wall 262. A top wall 214 and inclined wall 262 partially define an interior space between a diffuser inlet 220 and a diffuser outlet 222. Blower assembly 232 forces airstream 240 into diffuser 210 through diffuser inlet 220. From diffuser inlet 220 to diffuser outlet 222, inclined wall 262 slants away from top wall 214 to expand the cross-sectional area of diffuser 210. As airstream 240 flows through diffuser 210, airstream 240 expands with the increasing cross-sectional area of diffuser 210 and the speed of airstream 240 decreases. The difference in the airstream velocity between the portion of airstream 240 flowing through diffuser inlet 220 and the portion within diffuser 210 increases the pressure in diffuser 210 and causes a portion of airstream 240 to recirculate adjacent diffuser inlet 220. This recirculation causes adverse flow structures and other inefficiencies. Airstream 240 also separates from inclined wall 262, which results in the generation of additional adverse flow structures.

In the exemplary embodiment, as seen in FIG. 4, diffuser 110 alleviates the recirculation and separation problems by redirecting airstream 140 along curved bottom wall 116. Airstream 140 enters diffuser inlet 120, is turned by turning vane 156 towards first curved portion 124, and begins traveling along first curved portion 124 prior to any change in cross-sectional area. Therefore, airstream 140 maintains its velocity along curved bottom wall 116 as the cross-sectional area of diffuser 110 gradually increases. Airstream 140 flows along first curved portion 124 to straight portion 126, follows straight portion 126 until it reaches second curved portion 128, and gradually curves in a desired direction to exit diffuser 110 through diffuser outlet 122. Airstream 140 can be directed similarly or differently from the direction of airstream 140 when entering diffuser inlet 120.

Figure 6:
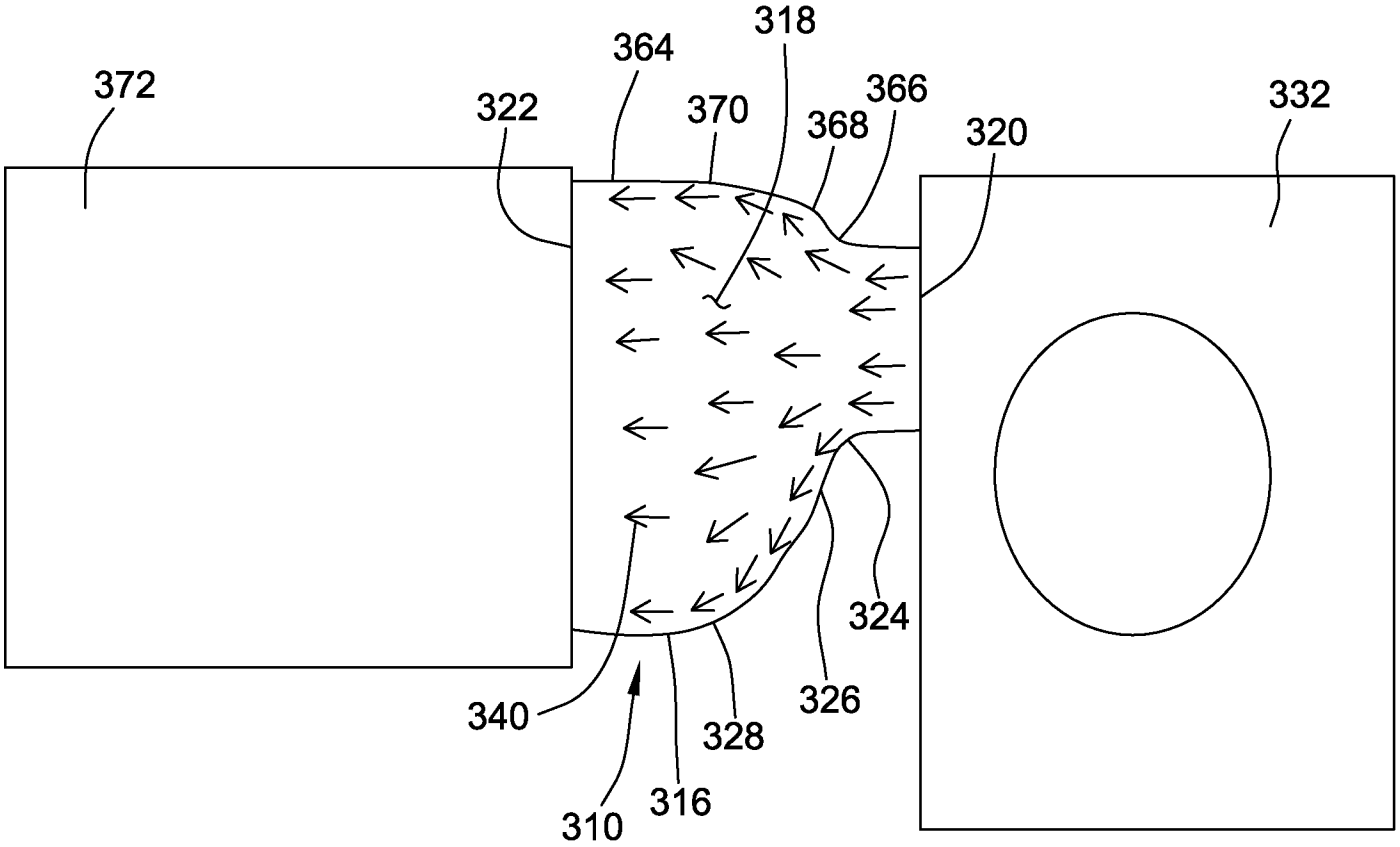
FIG. 6 is side view of an alternate embodiment of a diffuser.
Figure 7:
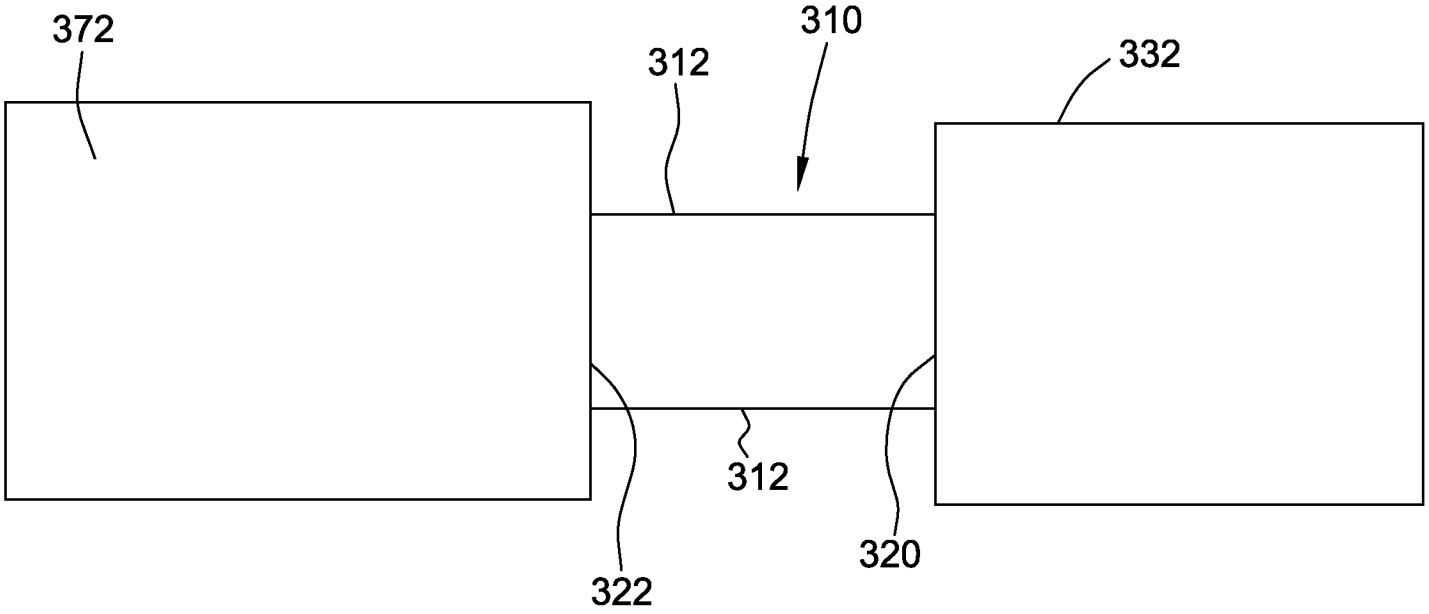
FIG. 7 is a top view of the diffuser shown in FIG. 6.

FIG. 6 is a side view of an alternate embodiment of a diffuser 310 and FIG. 7 is a top view of diffuser 310. Diffuser 310 has two sidewalls 312 and a curved bottom wall 316 similar to sidewalls 12 and curved bottom wall 16 of diffuser 10. Diffuser 310 further includes a curved top wall 364. Curved top wall 364 and curved bottom wall 316 are coupled between sidewalls 312 and are spaced a varying distance apart. Sidewalls 312, curved top wall 364, and curved bottom wall 316 define an interior space 318 with a diffuser inlet 320 at one end and a diffuser outlet 322 at the other end. The cross-sectional area of interior space 318 gradually increases from diffuser inlet 320 to diffuser outlet 322.

Curved top wall 364 has a first curved portion 366, a straight portion 368, and a second curved portion 370. First curved portion 366 is located adjacent diffuser inlet 320 and gradually curves away from curved bottom wall 316. From the reference of interior space 318, first curved portion 366 is convex. Straight portion 368 extends between first curved portion 366 and second curved portion 370. Second curved portion 370 is located adjacent diffuser outlet 322. From the reference of interior space 318, second curved portion 370 is concave. In the direction of airstream 340 through diffuser 310, the distance between curved bottom wall 316 and curved top wall 364 increases. In alternate embodiments, sidewalls 312 curve similar to curved bottom wall 316 and curved top wall 364.

In the exemplary embodiment, diffuser 310 is coupled to a blower assembly 332 adjacent diffuser inlet 320. Blower assembly 332 forces airstream 340 into diffuser inlet 320. Additionally, diffuser 310 is coupled to a duct assembly 372 adjacent diffuser outlet 322. Accordingly, airstream 340 enters diffuser inlet 320, travels through interior space 318, and exits through diffuser outlet 322. After exiting diffuser 310 through diffuser outlet 322, airstream 340 enters duct assembly 372.

While passing through diffuser 310, airstream 340 follows the curves of both curved top wall 364 and curved bottom wall 316 to maintain its velocity as the cross-sectional area of diffuser 310 gradually increases. Following curved bottom wall 316, airstream 340 flows along first curved portion 324 to straight portion 326, follows straight portion 326 until it reaches second curved portion 328, and is gradually redirected. Following curved top wall 364, airstream 340 flows along first curved portion 366 to straight portion 368, follows straight portion 368 until it reaches second curved portion 370, and is gradually redirected again. Second curved portions 328, 370 curve airstream 340 to a desired direction for exiting diffuser 310 through diffuser outlet 322. Alternate embodiments may include any number of curved walls. Two or more curved diffuser walls allow for a greater change in area without generating more adverse flow structures and inefficiencies. Additionally, a combination of multiple curved walls can each include less of a curve and still efficiently change the airstream cross-sectional area.

Figure 8:
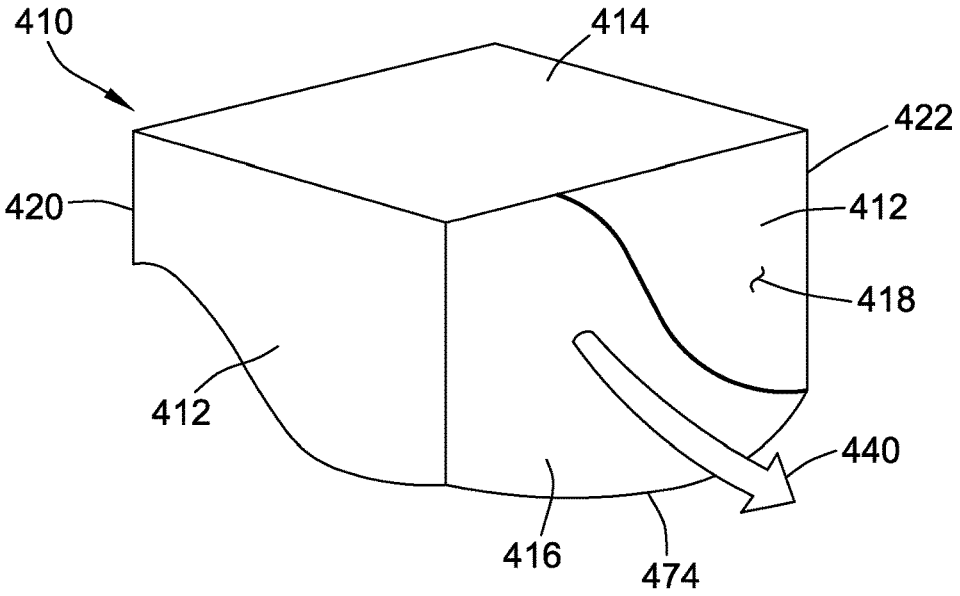
FIG. 8 is a perspective view of an alternate embodiment of a diffuser where the curved bottom wall curves in two directions.
Figure 9:
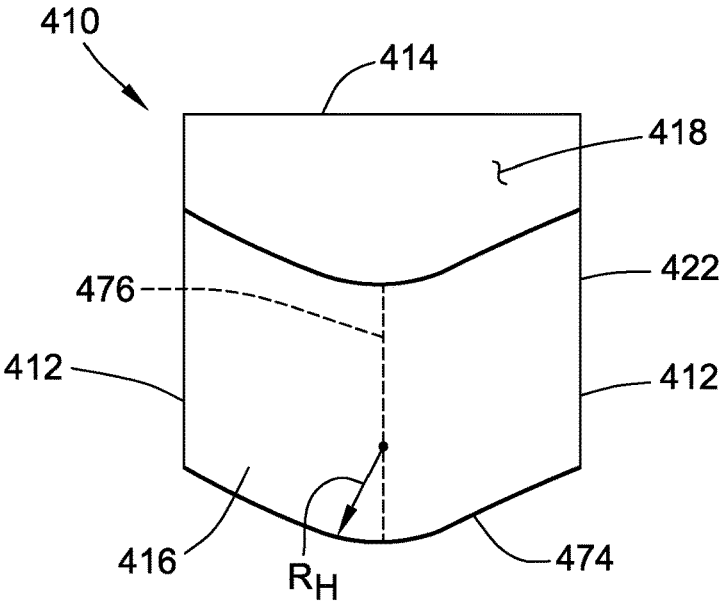
FIG. 9 is a front view of the diffuser shown in FIG. 8.

FIG. 8 is a perspective view of an alternate embodiment of a diffuser 410 where a curved bottom wall 416 curves in two directions, i.e., a compound curve. FIG. 9 is a front view of diffuser 410. In the exemplary embodiment, diffuser 410 has two sidewalls 412, a top wall 414, and curved bottom wall 416 defining an interior space 418. Interior space 418 has a diffuser inlet 420 at one end and a diffuser outlet 422 at the other end similar to interior space 18 having diffuser inlet 20 at one end and diffuser outlet 22 at the other end. Airstream 440 follows curved bottom wall 416 to maintain momentum as the cross-sectional area of airstream 440 increases. In the direction airstream 440 travels, curved bottom wall 416 gradually curves away from top wall 414.

Additionally, curved bottom wall 416 has a horizontal curve 474 in a direction perpendicular to the direction airstream 440 travels. Curved bottom wall 416 has a middle line 476 located equidistant from sidewalls 412 and curved bottom wall 416 curves up from middle line 476 to both sidewalls 412 to form horizontal curve 474, which is a general U-shape. Specifically, horizontal curve 474 is concave from the reference of interior space 418. Due to horizontal curve 474, airstream 440 flows across the entire width of curved bottom wall 416 without being backed up or trapped in corners. In alternate embodiments, horizontal curve 474 of curved bottom wall 416 may have other curved and straight configurations without departing from features of this disclosure. For example, an alternate diffuser (not shown) may have curved sections adjacent its sidewalls and a flat section extending between the curved sections. Alternately, a diffuser (not shown) comprising one horizontally curved sidewall that forms a general cylinder shape could also curve in the direction of an airstream.

In the exemplary embodiment, horizontal curve 474 has a horizontal radius $R_H$. In one embodiment, horizontal radius $R_H$ varies along the horizontal direction of horizontal curve 474. Horizontal curve 474 may be based on a mathematical formula to give curved bottom wall 416 an elliptical, parabolic, or other mathematical curve shape. In other embodiments, horizontal curve 474 may have a circular shape, where horizontal radius $R_H$ is constant along all of horizontal curve 474.

Figure 10:
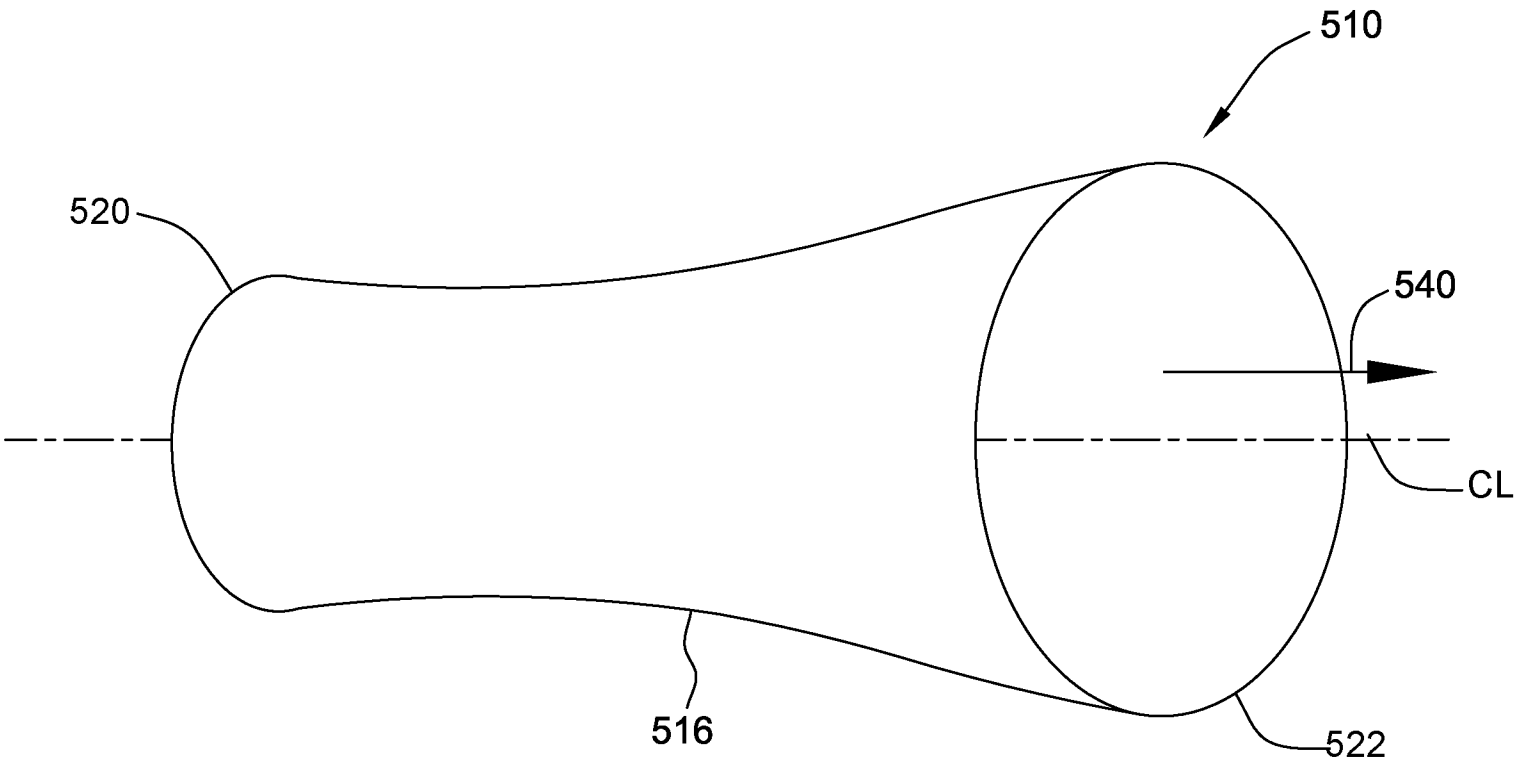
FIG. 10 is a perspective view of an alternate embodiment of a diffuser having a circular curved wall.

FIG. 10 is a perspective view of a diffuser 510 having a circular curved wall 516. An airstream 540 flows through diffuser 510 from a diffuser inlet 520 to a diffuser outlet 522. Circular curved wall 516 extends from diffuser inlet 520 to diffuser outlet 522 to form a continuous sidewall having a generally circular cross section. Similar to curved bottom wall 116 of diffuser 110, circular curved wall 516 curves in the direction of airstream 540. Thus, the circular cross-sectional area of diffuser 510 increases from diffuser inlet 520 to diffuser outlet 522 and, therefore, airstream 540 expands in cross-sectional area as it flows from diffuser inlet 520 to diffuser outlet 522. A centerline CL extends through the center of diffuser 510. Since circular curved wall 516 curves uniformly along its perimeter, any cross section of diffuser 510 taken perpendicular to the direction of airstream 540 will be a circle with a center point on centerline CL, e.g., diffuser inlet 520 and diffuser outlet 522 both have center points on centerline CL. In other embodiments, however, circular curved wall 516 curves along only a portion of its perimeter and has a cross section of any shape. Additionally, in alternate embodiments, diffuser 510 has a sidewall with any shape and any number of curves.

Exemplary embodiments of the diffuser are described above in detail. The diffuser and its components are not limited to the specific embodiments described herein, but rather, components of the systems may be utilized independently and separately from other components described herein. For example, the components may also be used in combination with other machine systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A diffuser for expanding the cross-sectional area of an airstream comprising:

an inlet comprising an inlet cross-sectional area;

an outlet comprising an outlet cross-sectional area, said outlet cross-sectional area greater than said inlet cross-sectional area, wherein said diffuser is configured to enable an airstream to move in an airstream direction from said inlet to said outlet;

a curved sidewall extending from said inlet to said outlet and at least partially defining an inner passageway, said curved sidewall comprising a convex portion and a concave portion, wherein said convex portion and said concave portion are curved in a first direction parallel to the airstream direction; and a turning vane disposed between said inlet and said outlet and configured to channel air towards said curved sidewall, wherein said turning vane has a convex portion that is aligned with said curved sidewall convex portion and a concave portion that is aligned with said curved sidewall concave portion to facilitate the airstream following said curved sidewall.

2. The diffuser of claim 1 further comprising a second curved sidewall extending from said inlet to said outlet.

3. The diffuser of claim 1, wherein said curved sidewall comprises a middle straight portion extending between said curved sidewall convex portion and said curved sidewall concave portion.

4. The diffuser of claim 1, wherein said curved sidewall convex portion has an upper radius and said curved sidewall concave portion has a lower radius, said upper radius and said lower radius being equal.

5. The diffuser of claim 1, wherein said curved sidewall convex portion is adjacent said inlet and said curved sidewall concave portion is adjacent said outlet.

6. The diffuser of claim 5, wherein said curved sidewall comprises an upper straight portion extending from said inlet to said curved sidewall convex portion and a lower straight portion extending from said curved sidewall concave portion to said outlet.

7. The diffuser of claim 1, wherein said curved sidewall convex portion has an upper radius that varies along the curve of said curved sidewall convex portion.

8. The diffuser of claim 7, wherein said curved sidewall concave portion has a lower radius that varies along the curve of said curved sidewall concave portion.

9. The diffuser of claim 1 further comprising a first sidewall and a second sidewall parallel to said airstream direction, said curved sidewall coupled between said first sidewall and said second sidewall, wherein said curved sidewall has a horizontal curve in a second direction perpendicular to the airstream direction to form a compound curve, said horizontal curve extending from said first sidewall to said second sidewall.

10. The diffuser of claim 9, wherein said horizontal curve has a concave shape.

11. A method for expanding and directing an airstream in a diffuser, said method comprising:

channeling the airstream into the diffuser through an inlet, the airstream having a first cross-sectional area when the airstream enters the diffuser at the inlet, the diffuser including a first curved wall with a first curve and a second curve;

deflecting the airstream off a convex portion of a turning vane towards the first curved wall, wherein the convex portion is aligned with the first curve of the first curved wall to facilitate the airstream following the first curved wall;

channeling the airstream in a first direction along the first curve of the first curved wall;

channeling the airstream along a straight portion of the first curved wall, wherein the straight portion extends between the first curve and the second curve;

expanding the cross-sectional area of the airstream to a second cross-sectional area as the airstream moves along the straight portion of the first curved wall;

deflecting the airstream off a concave portion of the turning vane towards the first curved wall, wherein the concave portion is aligned with the second curve of the first curved wall to facilitate the airstream following the first curved wall;

channeling the airstream in a second direction as the airstream moves along the second curve of the first curved wall; and exhausting the airstream from an outlet.

12. The method of claim 11, wherein channeling the airstream in a first direction comprises channeling the airstream in a first direction along the first curve of the first curved wall, the first curve having a varying radius along its length.

13. The method of claim 11 further comprising deflecting the airstream off a convex portion of the turning vane towards the first curved wall, wherein the convex portion is aligned with the first curve of the first curved wall to facilitate the airstream following the first curved wall.

14. The method of claim 11 further comprising channeling the airstream across a horizontal curve of the first curved wall after expanding the cross-sectional area of the airstream and prior to channeling the airstream in the second direction, wherein the horizontal curve extends in a direction perpendicular to the first direction and the second direction such that the first curved wall includes a compound curve.

15. An air handling system comprising:

a radial blower configured to move an airstream;

a blower housing configured to house said blower and channel the airstream around said blower, said blower housing including a blower outlet configured to exhaust the airstream;

a diffuser comprising a curved wall, a diffuser inlet configured to receive the airstream from said blower, and a diffuser outlet configured to exhaust the airstream, said diffuser comprising a first cross-sectional area at said diffuser inlet and a second cross-sectional area at said diffuser outlet, said second cross-sectional area greater than said first cross-sectional area, said curved wall including a first curve and a second curve; and a turning vane coupled to said diffuser and configured to channel air towards said curved wall, wherein said turning vane has a convex portion that is aligned with said first curve and a concave portion that is aligned with said second curve to facilitate the airstream following said curved wall.

16. The air handling system of claim 15 further comprising a second turning vane coupled to said diffuser adjacent said diffuser inlet, said second turning vane angled to channel air towards said curved wall.

17. The air handling system of claim 15 further comprising a second turning vane coupled to said diffuser adjacent said diffuser outlet.

18. The air handling system of claim 15 further comprising a second curved wall comprising a first curve and a second curve.

19. The air handling system of claim 15 wherein the airstream moves in an airstream direction from said diffuser inlet to said diffuser outlet, said curved wall extending from said diffuser inlet to said diffuser outlet in said airstream direction.

20. The air handling system of claim 19 wherein said diffuser further comprises a first sidewall and a second sidewall parallel to said airstream direction, said curved wall coupled between said first sidewall and said second sidewall, wherein said curved wall includes a horizontal curve in a direction perpendicular to the airstream direction, wherein the horizontal curve extends from said first sidewall to said second sidewall.

* * * * *